US010781804B2

(12) United States Patent
Higashidozono et al.

(10) Patent No.: US 10,781,804 B2
(45) Date of Patent: Sep. 22, 2020

(54) DISPLACEMENT CONTROL VALVE

(71) Applicant: EAGLE INDUSTRY CO., LTD., Tokyo (JP)

(72) Inventors: Hideki Higashidozono, Tokyo (JP); Masahiro Hayama, Tokyo (JP); Kohei Fukudome, Tokyo (JP); Daichi Kurihara, Tokyo (JP)

(73) Assignee: EAGLE INDUSTRY CO., LTD. (JP)

( * ) Notice: Subject to any disclaimer, the term of this patent is extended or adjusted under 35 U.S.C. 154(b) by 0 days.

(21) Appl. No.: 16/323,180

(22) PCT Filed: Aug. 22, 2017

(86) PCT No.: PCT/JP2017/029833

§ 371 (c)(1),
(2) Date: Feb. 4, 2019

(87) PCT Pub. No.: WO2018/043186

PCT Pub. Date: Mar. 8, 2018

(65) Prior Publication Data

US 2019/0162175 A1 May 30, 2019

(30) Foreign Application Priority Data

Aug. 29, 2016 (JP) ..... 2016-166844

(51) Int. Cl.
*F04B 27/18* (2006.01)

(52) U.S. Cl.
CPC ..... *F04B 27/18* (2013.01); *F04B 2027/1813* (2013.01); *F04B 2027/1822* (2013.01);
(Continued)

(58) Field of Classification Search
CPC ..... F04B 27/18; F04B 27/1804; F04B 2027/1813; F04B 2027/1822; F04B 2027/1854; F04B 2027/1809–1895; F16K 31/0613; F16K 31/0163; F16K 31/06; F16K 31/0624; F16K 11/0716; G05D 16/0619;
(Continued)

(56) References Cited

U.S. PATENT DOCUMENTS 8,079,827 B2 * 12/2011 Iwa ..... F04B 27/1804 137/3
8,449,266 B2 * 5/2013 Higashidozono ... F04B 27/1804 417/222.2
(Continued)

FOREIGN PATENT DOCUMENTS

JP 2012-211579 A 11/2012
JP 5167121 B2 3/2013
(Continued)

*Primary Examiner* — Craig J Price
(74) *Attorney, Agent, or Firm* — Harness, Dickey & Pierce, P.L.C.

(57) ABSTRACT

A displacement control valve is provided for discharging liquid refrigerant in a control chamber at startup and achieves a reduction in startup time and an improvement in operating efficiency during control of a variable displacement compressor simultaneously. The opening area between communicating holes in a third valve section and a third valve seat surface in a control area to control the flow rate or pressure in a working control chamber is set smaller than the area of auxiliary communicating passages.

2 Claims, 6 Drawing Sheets

(52) U.S. Cl.
CPC ..... *F04B 2027/1854* (2013.01); *Y10T 137/86622* (2015.04); *Y10T 137/86702* (2015.04)

(58) Field of Classification Search
CPC ..... G05D 16/2013; Y10T 137/86622; Y10T 137/87217; Y10T 137/86485; Y10T 137/86702
USPC ..... 137/625.65, 625.68, 596.17; 417/222.2; 62/228.3; 91/473, 482, 483, 504, 505; 251/129.15
See application file for complete search history.

(56) References Cited

U.S. PATENT DOCUMENTS

| | | | | |
|---|---|---|---|---|
| 8,651,826 | B2 * | 2/2014 | Futakuchi | F04B 27/1804 417/222.2 |
| 8,757,988 | B2 * | 6/2014 | Fukudome | F04B 27/1804 417/270 |
| 8,931,517 | B2 * | 1/2015 | Okamoto | F16K 31/0624 137/625.68 |
| 9,132,714 | B2 * | 9/2015 | Futakuchi | F04B 27/1804 |
| 9,777,863 | B2 * | 10/2017 | Higashidozono | F16K 31/0624 |
| 10,077,849 | B2 * | 9/2018 | Iwa | G05D 16/2024 |
| 10,337,636 | B2 * | 7/2019 | Futakuchi | F16K 31/061 |
| 2009/0183786 | A1 | 7/2009 | Iwa et al. | |
| 2012/0056113 | A1 | 3/2012 | Tano et al. | |
| 2019/0078562 | A1 * | 3/2019 | Hayama | F16K 11/025 |
| 2020/0032781 | A1 * | 1/2020 | Higashidozono | F04B 27/1804 |

FOREIGN PATENT DOCUMENTS

| | | | |
|---|---|---|---|
| WO | WO-2007-119380 | A1 | 10/2007 |
| WO | WO-2017-159553 | A1 | 9/2017 |

* cited by examiner

S1 is the total area of the auxiliary communicating passages 21E.

AT LIQUID REFRIGERANT DISCHARGE TIME

DURING CONTROL

AT OFF TIME

DISPLACEMENT CONTROL VALVE

CROSS REFERENCE TO RELATED APPLICATIONS

This application is a U.S. National Stage Application of International Application No. PCT/JP2017/029833, filed on Aug. 22, 2017, and published in Japanese as WO 2018/043186 on Mar. 8, 2018 and claims priority to Japanese Application No. 2016-166844, filed on Aug. 29, 2016. The entire disclosures of the above applications are incorporated herein by reference.

BACKGROUND

Technical Field

The present invention relates to a displacement control valve that variably controls the displacement or pressure of a working fluid, and in particular, relates to a displacement control valve that controls the discharge rate of a variable displacement compressor or the like used in an air-conditioning system of an automobile or the like, according to pressure load.

Related Art

A swash-plate variable displacement compressor used in an air-conditioning system of an automobile or the like includes a rotating shaft rotationally driven by the torque of an engine, a swash plate connected to the rotating shaft such that its inclination angle to the rotating shaft can be changed, compression pistons connected to the swash plate, and others. The compressor controls the discharge rate of refrigerant gas by changing the inclination angle of the swash plate and thereby changing the stroke of the pistons.

The inclination angle of the swash plate can be continuously changed by properly controlling the pressure in a control chamber, using a displacement control valve that is driven by an electromagnetic force to open and close, and thereby adjusting the balance of pressures acting on opposite faces of the pistons, while using the suction pressure in a suction chamber for sucking the refrigerant gas, the discharge pressure in a discharge chamber for discharging the refrigerant gas pressurized by the pistons, and the control chamber pressure in the control chamber (crank chamber) accommodating the swash plate.

As such a displacement control valve, there is known one that includes, as shown in FIG. 5, second communicating passages 73 and a valve hole 77 that communicate a discharge chamber and a control chamber, a second valve chest 82 formed at an intermediate point in a discharge-side passage, third communicating passages 71 and a circulation groove 72 that communicate a suction chamber and the control chamber, a third valve chest 83 formed at an intermediate point in a suction-side passage, a valve element 81 formed such that a second valve section 76 that is disposed in the second valve chest 82 to open and close the second communicating passages 73 and the valve hole 77 and a third valve section 75 that is disposed in the third valve chest 83 to open and close the third communicating passages 71 and the circulation groove 72 reciprocate in an integrated manner while performing opening and closing operation in opposite directions, a first valve chest (displacement chamber) 84 formed close to the control chamber, a pressure-sensitive element (bellows) 78 that is disposed in the first valve chest and exerts a biasing force in the extending (expanding) direction and contracts with an increase in ambient pressure, a valve seat element (engaging portion) 80 that is provided at a free end of the pressure-sensitive element in the extending and contracting direction and has an annular seat surface, a first valve section (opening valve connection portion) 79 that moves with the valve element 81 in an integrated manner in the first valve chest 84 and can open and close the suction-side passage by being engaged with and disengaged from the valve seat element 80, a solenoid S that exerts an electromagnetic drive force on the valve element 81, and others (Hereinafter, it is referred to as a "conventional art." See JP 5167121 B1, for example).

A displacement control valve 70 is configured to be able to adjust the pressure in the control chamber (control chamber pressure) Pc by communicating the discharge chamber and the control chamber when there arises a need to change the control chamber pressure during displacement control, without having to provide a clutch mechanism to the variable displacement compressor. The displacement control valve 70 is also configured to open the suction-side passage by disengaging the first valve section (opening valve connection portion) 79 from the valve seat element (engaging portion) 80 and thereby communicating the suction chamber and the control chamber when the control chamber pressure Pc increases in the variable displacement compressor in a stopped state.

When the swash-plate variable displacement compressor is started after it has been stopped and left for a long period of time, liquid refrigerant (refrigerant gas cooled and liquefied while the compressor being left) accumulates in the control chamber (crank chamber). Thus, unless the liquid refrigerant is discharged, a discharge rate as set cannot be achieved by the compression of the refrigerant gas.

To perform desired displacement control immediately after startup, it is necessary to discharge liquid refrigerant in the control chamber (crank chamber) as rapidly as possible.

For this, the above conventional art provides an auxiliary communicating passage 85 in the valve seat element (engaging portion) 80 to enable communication from the displacement chamber 84 through the auxiliary communicating passage 85 and an intermediate communicating passage 86 to the third communicating passages 71 under a suction pressure (see an arrow). When the variable displacement compressor is started for cooling, this configuration can vaporize refrigerant liquid in the control chamber at 1/10 to 1/15 the speed of a displacement control valve without the auxiliary communicating passage 85, to bring the compressor into cooling operation.

FIG. 5 is a state where a current flows through the solenoid unit S. On the other hand, when no current flows through the solenoid unit S, an opening spring means 87 brings the third valve section 75 into a closed state, which is not shown. At this time, the second valve section 76 is in an open state. The first valve section 79 opens under the suction pressure Ps and the control pressure Pc.

The first valve section 79 and the valve seat surface of the valve seat element 80 are configured such that they cannot open widely for functional reasons. Refrigerant liquid in the control chamber is vaporized, and fluid at the control pressure Pc flows through first communicating passages 74 into the first valve chest 84. In this state, the control pressure Pc and the suction pressure Ps are high, and thus the pressure-sensitive element (bellows) 78 contracts, opening a space between the first valve section 79 and the valve seat surface of the valve seat element 80. Only with this valve opening state, however, the vaporization of the refrigerant liquid in the control chamber 84 is accelerated only in small quantities. The provision of the auxiliary communicating passage 85 communicating with the intermediate communicating passage 86 allows the refrigerant liquid in the control chamber to be vaporized rapidly.

In the above conventional art, however, the refrigerant gas flows from the control chamber into the suction chamber even when the space between the first valve section 79 and the valve seat surface of the valve seat element 80 is closed and the flow of fluid through the auxiliary communicating passage 85 is unnecessary, for example, during the control of the variable displacement compressor thus resulting in a reduction in the operating efficiency of the variable displacement compressor.

This point will be described in detail with reference to FIG. 6.

In FIG. 6, the conventional art is designed as follows:

S2>S1

L>LS where S1 is the (fixed) area of the auxiliary communicating passage 85, S2 is the maximum opening area of the third valve section 75, L is the maximum stroke of the valve element 81 (stroke from full closing to full opening), and LS is the stroke of the valve element 81 in a control area.

Therefore, as shown by a solid line in FIG. 6, refrigerant gas defined by the area S1 of the auxiliary communicating passage 85 flows from the control chamber into the suction chamber in the whole control area, and the flow of the refrigerant gas is restricted only after the valve element 81 exceeds the control area and approaches the maximum stroke. Thus, a reduction in operating efficiency during control of the variable displacement compressor is unavoidable.

The present invention has been made to solve the above-described problem of the conventional art, and its object is to provide a displacement control valve that is provided with an auxiliary communicating passage to be improved in the function of discharging liquid refrigerant in a control chamber at the time of startup of a variable displacement compressor. The displacement control valve can achieve a reduction in startup time and an improvement in operating efficiency during control of the variable displacement compressor simultaneously by setting the opening area of a third valve section for opening and closing third communicating passages and a circulation groove during the control of the variable displacement compressor smaller than or equal to the opening area of the auxiliary communicating passage.

SUMMARY OF THE INVENTION

To attain the above object, a displacement control valve according to a first aspect of the present invention, which controls a flow rate or pressure in a working control chamber according to a degree of opening of a valve unit, includes a valve body having a first valve chest that communicates with first communicating passages for passing fluid at control pressure and has a first valve seat surface and a second valve seat surface, a second valve chest that has a valve hole communicating with the first valve chest and communicates with second communicating passages for passing fluid at discharge pressure, a third valve chest that communicates with third communicating passages for passing fluid at suction pressure and is next to a third valve seat surface, a valve element disposed in the valve body and having an intermediate communicating passage that communicates the first valve chest and the third communicating passages, a second valve section that separates from and comes into contact with the second valve seat surface to open and close the valve hole communicating with the first valve chest and the second valve chest, a third valve section that opens and closes opposite to and in conjunction with the second valve section and has a communicating hole that slides relatively to the third valve seat surface to open and close communication between the intermediate communicating passage and the third communicating passages, and a first valve section that is disposed in the first valve chest and opens and closes opposite to and in conjunction with the second valve section, a pressure-sensitive element that is disposed in the third valve chest and extends and contracts in response to suction pressure, the pressure-sensitive element having, at an extending and contracting free end thereof, a valve seat that separates from and comes into contact with the third valve section to open and close communication between the third valve chest and the intermediate communicating passage, an auxiliary communicating passage provided in the first valve section in the first valve chest for enabling communication between an interior of the first valve chest and the intermediate communicating passage, and a solenoid unit mounted to the valve body and actuating the valve element in a travel direction to open and close the valve sections of the valve element according to a current, in which an opening area S2 between the communicating hole in the third valve section and the third valve seat surface in a control area to control the flow rate or pressure in the working control chamber is set smaller than an area S1 of the auxiliary communicating passage.

According to this aspect, the displacement control valve, which is provided with the auxiliary communicating passage to be improved in the function of discharging liquid refrigerant in the control chamber at the time of startup of the variable displacement compressor, can reduce the minimum area of a Pc-Ps flow path in the control area, and can achieve a reduction in startup time and an improvement in operating efficiency during control of the variable displacement compressor simultaneously.

Further, the displacement control valve, in which the auxiliary communicating passage is provided in the first valve section in the first valve chest in which fluid at the control pressure acts, and the pressure-sensitive device and the third valve section for discharging liquid refrigerant are disposed in the third valve chest in which fluid at the suction pressure acts, can reduce the minimum area of the Pc-Ps flow path in the control area by the simple configuration of providing the communicating hole in the third valve section of the valve element.

According to a second aspect of the present invention, in the displacement control valve in the first aspect, a maximum opening area S2max between the communicating hole in the third valve section and the third valve seat surface when the second valve section is in a closed state is set equal to or smaller than the area S1 of the auxiliary communicating passage.

According to this aspect, the minimum area of the Pc-Ps flow path at the time of liquid refrigerant discharge can be made as large as that in the above-described conventional art.

Effects of the Invention

The present invention achieves the following outstanding effects.

(1) The opening area S2 between the communicating hole in the third valve section and the third valve seat surface in the control area to control the flow rate or pressure in the working control chamber is set smaller than the area S1 of the auxiliary communicating passage, so that the displacement control valve, which is provided with the auxiliary communicating passage to be improved in the function of discharging liquid refrigerant in the control chamber at the time of startup of the variable displacement compressor, can reduce the minimum area of the Pc-Ps flow path in the control area, and can achieve a reduction in startup time and an improvement in operating efficiency during control of the variable displacement compressor simultaneously.

Further, the displacement control valve, in which the auxiliary communicating passage is provided in the first valve section in the first valve chest in which fluid at the control pressure acts, and the pressure-sensitive device and the third valve section for discharging liquid refrigerant are disposed in the third valve chest in which fluid at the suction pressure acts, can reduce the minimum area of the Pc-Ps flow path in the control area by the simple configuration of providing the communicating hole in the third valve section of the valve element.

(2) The maximum opening area S2max between the communicating hole in the third valve section and the third valve seat surface when the second valve section is in a closed state is set equal to or smaller than the area S1 of the auxiliary communicating passage, so that the minimum area of the Pc-Ps flow path at the time of liquid refrigerant discharge can be made as large as that in the above-described conventional art.

DESCRIPTION OF EMBODIMENTS

Hereinafter with reference to the drawings, a mode for carrying out the present invention will be described illustratively based on embodiments. However, the dimensions, materials, shapes, relative positions, and others of components described in the embodiments are not intended to limit the present invention only to them unless otherwise explicitly described.

First Embodiment

Figure 1:
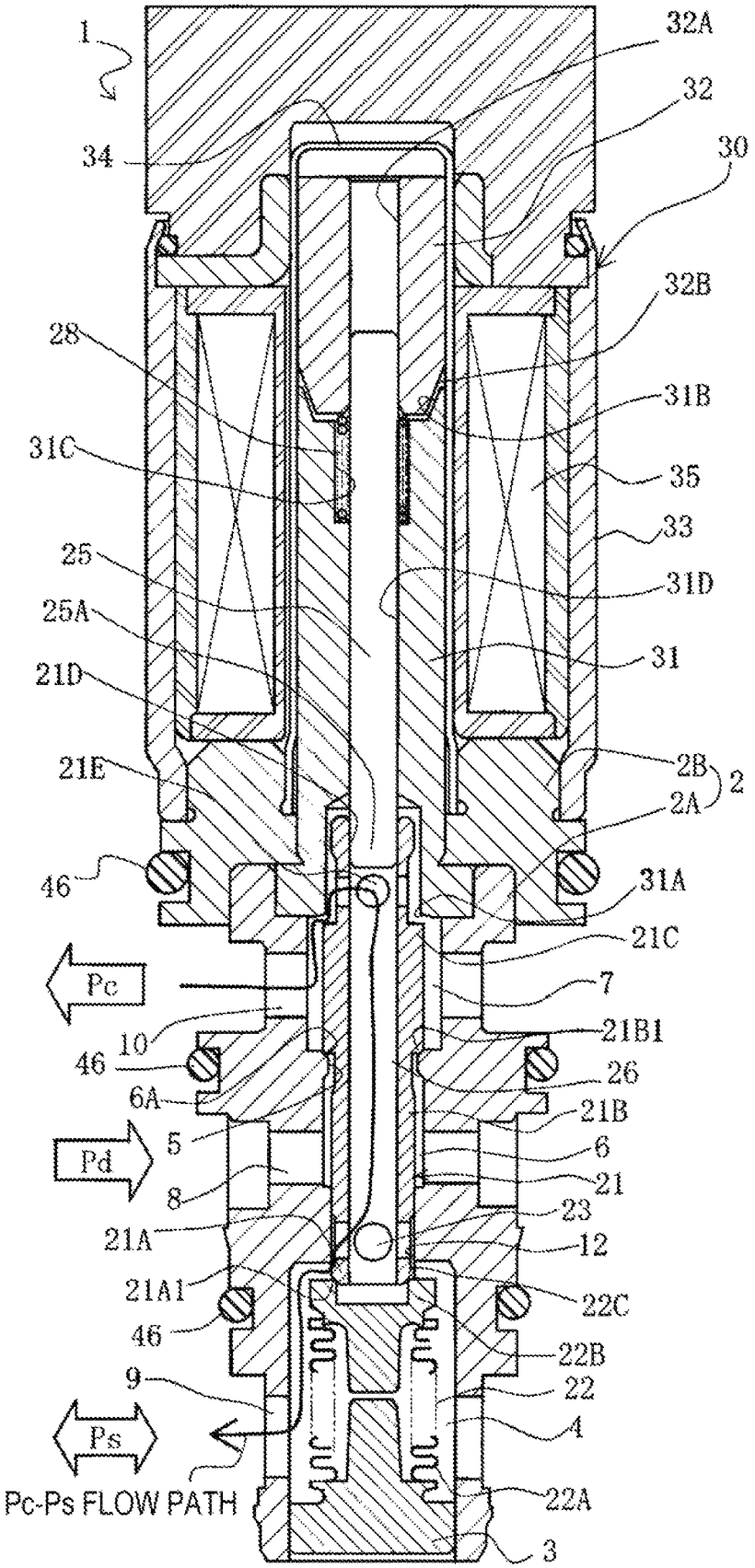
FIG. 1 is a front cross-sectional view showing a displacement control valve according to a first embodiment of the present invention.
Figure 2A:
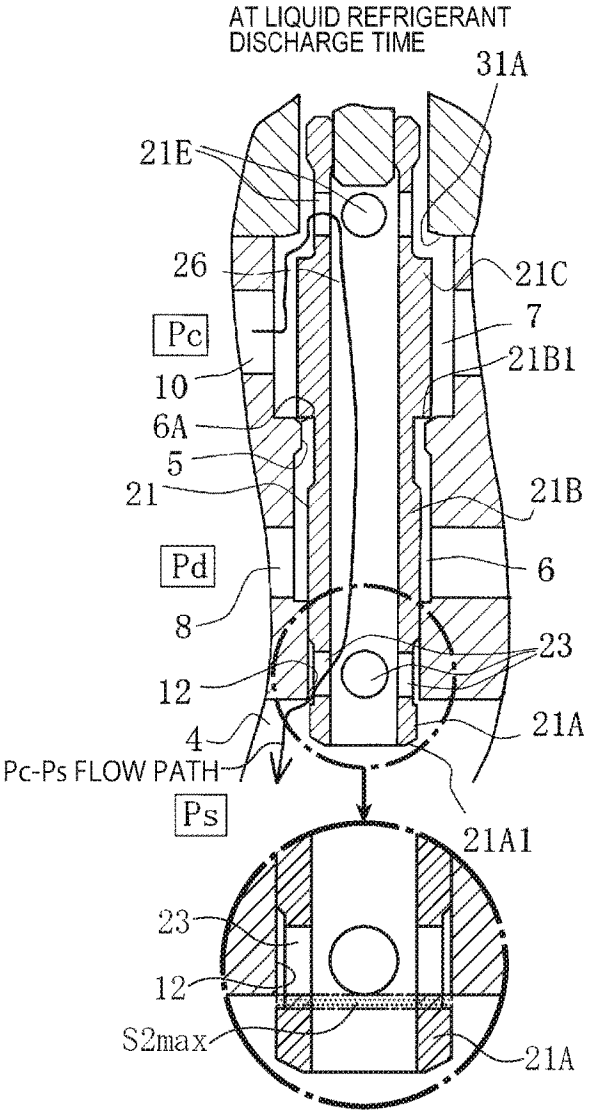
FIGS. 2A to 2C are enlarged views of a Pc-Ps flow path in FIG. 1, and are explanatory diagrams for explaining an opening area S2 between a third valve section and a third valve seat surface in different states.
Figure 2B:
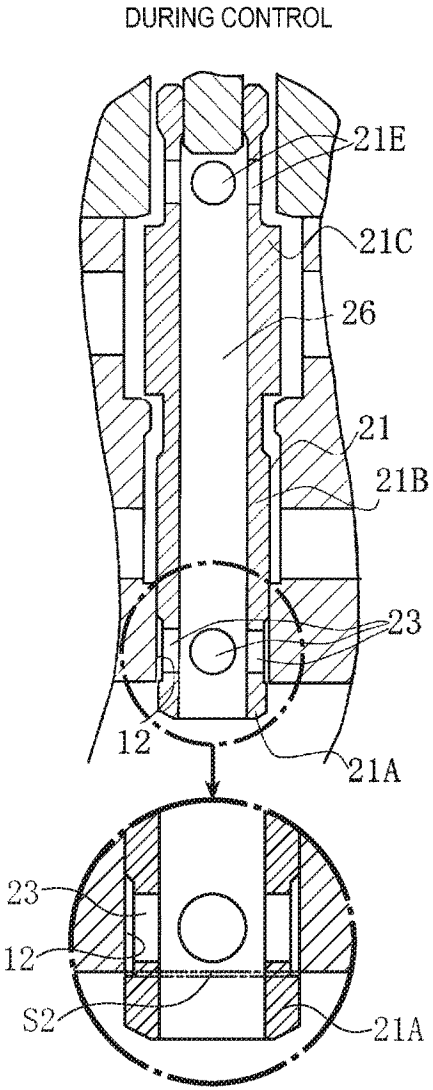
Figure 2C:
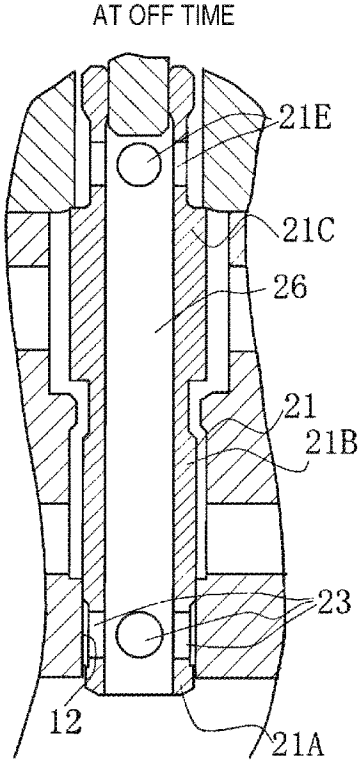
Figure 3:
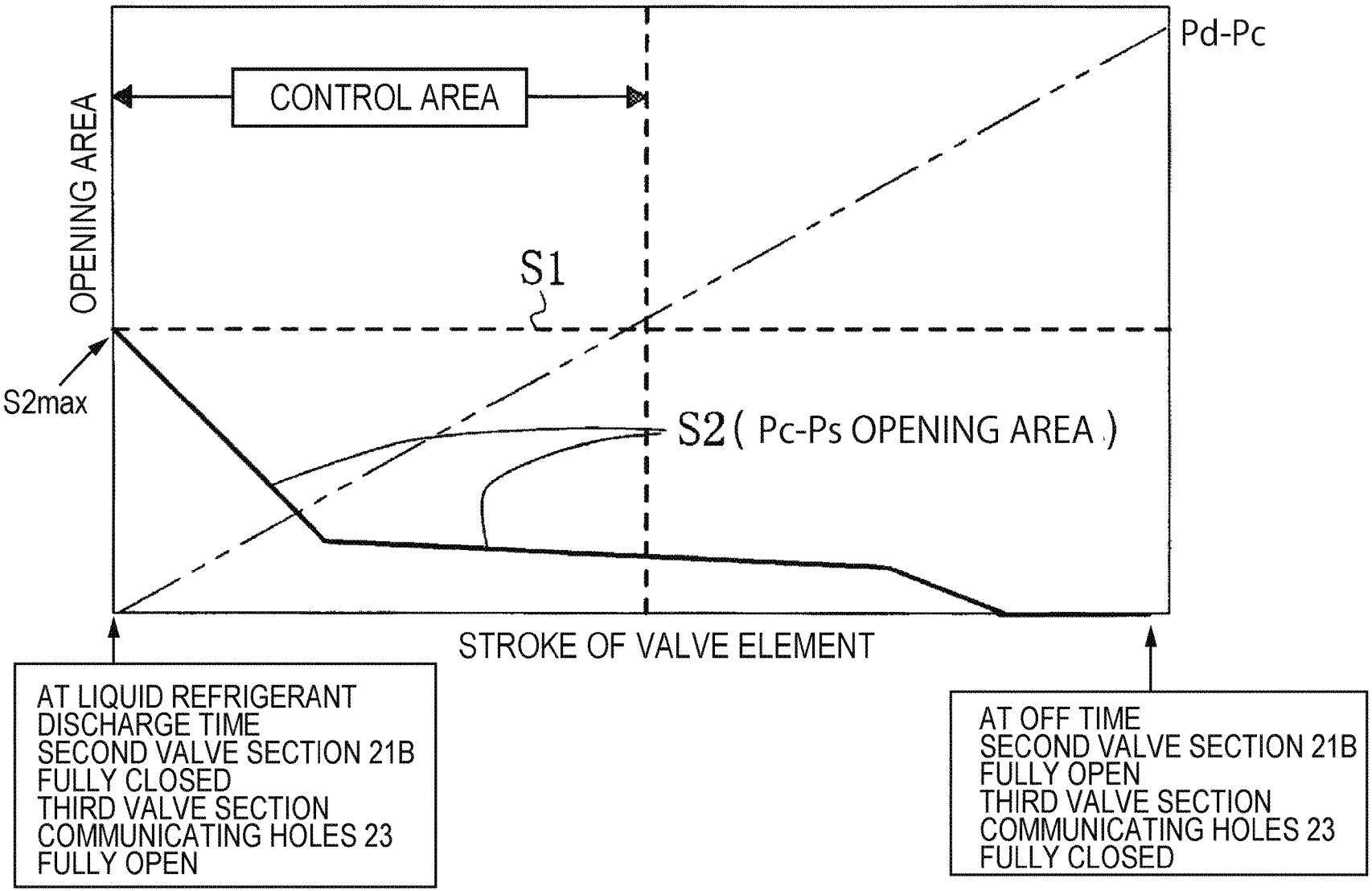
FIG. 3 is an explanatory diagram for explaining the relationship between the opening area S2 between the third valve section and the third valve seat surface and an area S1 of auxiliary communicating passages of the displacement control valve according to the first embodiment.

With reference to FIGS. 1 to 3, a displacement control valve according to a first embodiment of the present invention will be described.

In FIG. 1, reference numeral 1 denotes a displacement control valve. The displacement control valve 1 is provided with a valve body 2 forming an outside shape. The valve body 2 includes a first valve body 2A forming a through hole provided with functions inside, and a second valve body 2B integrally fitted to one end of the first valve body 2A. The first valve body 2A is made of a metal such as brass, iron, aluminum, or stainless, or a synthetic resin material, or the like. The second valve body 2B is formed of a magnetic substance such as iron.

The second valve body 2B is provided separately to be different in function from the material of the first valve body 2A because a solenoid unit 30 is connected to the second valve body 2B, and the second valve body 2B must be of a magnetic substance. If this point is considered, the shape shown in FIG. 1 may be changed appropriately. A partition adjuster 3 is connected to the first valve body 2A at the other end of the through hole. The partition adjuster 3 is fitted to close a third valve chest (hereinafter, sometimes referred to as a displacement chamber) 4 of the first valve body 2A. If screwed in and fixed with a setscrew not shown, the partition adjuster 3 can move and adjust the spring force of a compression spring disposed in parallel in a bellows 22A or the bellows 22A in the axial direction.

In a compartment of the through hole axially extending through the first valve body 2A, the third valve chest (displacement chamber) 4 is formed on the one-end side. Third communicating passages 9 are connected to the third valve chest (displacement chamber) 4. The third communicating passages 9 are configured to communicate with a suction chamber of a variable displacement compressor so that the displacement control valve 1 allows fluid at a suction pressure Ps to flow into the suction chamber and to flow out.

A pressure-sensitive element (hereinafter, referred to as a pressure-sensitive device) 22 is provided in the displacement chamber 4. The pressure-sensitive device 22 has the metal bellows 22A connected at one end to the partition adjuster 3 in a sealed state and connected at the other end to a valve seat 22B. The bellows 22A is made of phosphor bronze or the like, and its spring constant is designed to a predetermined value. The interior space of the pressure-sensitive device 22 is a vacuum, or contains air. The pressure-sensitive device 22 is configured such that the pressure in the displacement chamber 4 (e.g. pressure Pc) and the suction pressure Ps act on an effective pressure-receiving area Ab of the bellows 22A to contract the pressure-sensitive device 22. The dish-shaped valve seat 22B provided with a first valve seat surface 22C at an edge peripheral surface is provided at a free end of the pressure-sensitive device 22.

In the compartment of the through hole, a third valve seat surface 12 with a diameter smaller than the diameter of the third valve chest (displacement chamber) 4 is provided consecutively next to the third valve chest (displacement chamber) 4 on the upper side thereof (the side of the solenoid unit 30) in FIG. 1.

Further, in the compartment of the through hole, a second valve chest 6 is provided next to the third valve seat surface 12 on the upper side (the side of the solenoid unit 30) in FIG. 1. Furthermore, in the compartment of the through hole, a first valve chest 7 communicating with the second valve chest 6 is provided consecutively next to the second valve chest 6 on the upper side (the side of the solenoid unit 30) in FIG. 1. Between the second valve chest 6 and the first valve chest 7, a valve hole 5 with a diameter smaller than the diameters of these chests is provided consecutively. A second valve seat surface 6A is formed around the valve hole 5 on the side of the first valve chest 7.

A space between the third valve seat surface 12 and the second valve chest 6 is sealed by a sealing means.

Second communicating passages 8 are provided consecutively to the second valve chest 6 in the valve body 2. The second communicating passages 8 are configured to communicate with the interior of a discharge chamber of the variable displacement compressor (not shown) so that the displacement control valve 1 allows fluid at a discharge pressure Pd to flow into a control chamber.

Further, first communicating passages 10 are formed at the first valve chest 7 in the valve body 2. The first communicating passages 10 communicate with the control chamber (crank chamber) of the variable displacement compressor to allow fluid at the discharge pressure Pd flowing in from the second valve chest 6 to flow out to the control chamber (crank chamber) of the variable displacement compressor, which will be described later.

The first communicating passages 10, the second communicating passages 8, and the third communicating passages 9 are two to six in number, for example, and are spaced evenly around a peripheral surface of the valve body 2, extending therethrough. Further, an outer peripheral surface of the valve body 2 is formed into four-stage surfaces. The outer peripheral surface is provided with O-ring fitting grooves at three locations in the axial direction. In each fitting groove, an O-ring 46 is fitted to seal a space between the valve body 2 and a fitting hole of a casing (not shown) into which the valve body 2 is fitted.

A valve element 21 is disposed axially movably in the through hole axially extending through the first valve body 2A.

A third valve section 21A that opens and closes with the first valve seat surface 22C of the valve seat 22B is provided at one end of the valve element 21. The third valve section 21A is provided with a third valve section surface 21A1 that opens and closes with the first valve seat surface 22C.

The outside diameter of the third valve section 21A is set slightly smaller than the inside diameter of the third valve seat surface 12.

Further, at least one communicating hole 23 is provided in the third valve section 21A in such a position to slide on the third valve seat surface 12, and is opposite the third valve section surface 21A1. The at least one communicating hole 23 is communicated with an intermediate communicating passage 26 to be described below that axially extends through the valve element 21, and is provided circumferentially of the third valve section 21A to face the third valve seat surface 12.

Further, a second valve section 21B is provided as a connecting portion, opposite the third valve section surface 21A1 of the third valve section 21A of the valve element 21. The outside diameter of the second valve section 21B is made smaller than the diameter of the valve hole 5 so that fluid at the discharge pressure Pd can pass through the second valve chest 6 and the first valve chest 7 when the second valve section 21B is open.

The second valve section 21B at an intermediate portion of the valve element 21 is disposed in the second valve chest 6. The second valve section 21B is provided with a second valve section surface 21B1 to be joined to the second valve seat surface 6A.

A first valve section 21C above the second valve section 21B of the valve element 21 is disposed in the first valve chest 7. The first valve section 21C opens and closes with a first valve seat surface 31A formed at a lower end face of a fixed iron core 31.

The intermediate communicating passage 26 is provided in the interior of the valve element 21, extending from the first valve chest 7 to the third valve chest 4. When the first valve section 21C opens from the first valve seat surface 31A, control fluid Pc can flow out from the first valve chest 7 into the third communicating passages 9.

In the valve element 21, a connecting portion 25A provided at a lower end portion of a solenoid rod 25 is fitted into a fitting hole 21D of the valve element 21.

The valve element 21 is provided with, for example, four evenly-spaced auxiliary communicating passages 21E located below the fitting hole 21D in the first valve chest 7. Through the auxiliary communicating passages 21E, the first valve chest 7 communicates with the intermediate communicating passage 26.

The first valve chest 7 is formed with a surface with a diameter slightly larger than that of the outer shape of the valve element 21 to facilitate flowing of fluid at the control fluid Pc from the first communicating passages 10 into the first valve chest 7.

The above-described configuration of a lower part in FIG. 1 including the valve body 2, the valve element 21, and the pressure-sensitive device 22 constitutes a valve unit.

The area S1 of the auxiliary communicating passages 21E may be equal to or larger than the maximum opening area S2max of the at least one communicating hole 23.

The diameter of the auxiliary communicating passages 21E may vary, depending on the capacity of the air conditioner.

In a state where the pressure-sensitive device 22 is contracted according to the pressure of the control fluid Pc of vaporized refrigerant liquid, opening the third valve section 21A, time to vaporize refrigerant liquid is as long as ten minutes or longer. During this, the pressure in the control chamber of the swash-plate variable displacement compressor, which is in a vaporizing state, gradually increases, thus resulting in a further delay in vaporization. However, the provision of the auxiliary communicating passages 21E allows refrigerant liquid in the control chamber to be rapidly vaporized. When all the refrigerant liquid in the control chamber is vaporized, the displacement control valve 1 can freely control the pressure in the control chamber.

The at least one communicating hole 23 in the third valve section 21A is set so as to be in an open state when the second valve section surface 21B1 of the second valve section 21B is in a closed state, and to be in a closed state when the second valve section surface 21B1 is in an open state.

The other end portion opposite the connecting portion 25A of the solenoid rod 25 is fitted into a fitting hole 32A of a plunger 32 for connection. The fixed iron core 31 fixed to the first valve body 2A is provided between the valve element 21 and the plunger 32. The solenoid rod 25 is fitted movably along an inner peripheral surface 31D of the fixed iron core 31.

A spring seat chamber 31C is formed in the fixed iron core 31 on the side of the plunger 32. A spring means (hereinafter, also referred to as a resilient means) 28 for bringing the third valve section 21A and the second valve section 21B from a closed state into an open state is disposed in the spring seat chamber 31C. That is, the spring means 28 springs to separate the plunger 32 from the fixed iron core 31. An attraction surface 31B of the fixed iron core 31 and a joint surface 32B of the plunger 32 form opposing tapered surfaces, providing a gap between the opposing surfaces to enable attraction. The separation and contact between the attraction surface 31B of the fixed iron core 31 and the joint surface 32B of the plunger 32 depend on the strength of a current flowing through an electromagnetic coil 35. A solenoid case 33 is fixed to a step on the one-end side of the second valve body 2B. In the solenoid case 33, the electromagnetic coil 35 is disposed. The solenoid unit 30 presents the above overall configuration. The electromagnetic coil 35 provided in the solenoid unit 30 is controlled by a control computer (not shown).

A plunger case 34 is fitted to the fixed iron core 31. The plunger 32 is slidably fitted therein. The plunger case 34 is fitted at one end in a fitting hole in the second valve body 2B, and is fixed at the other end in a fitting hole in an end portion of the solenoid case 33. The above configuration constitutes the solenoid unit 30.

Note that in FIG. 1, a thick curved line of an arrow indicates a Pc-Ps flow path from one of the first communicating passages 10 to one of the third communicating passages 9.

Next, with reference to FIG. 2, the positional relationships between the first valve section 21C, the second valve section 21B, and the communicating holes 23 in the third valve section 21A will be described in detail.

At the time of liquid refrigerant discharge (at the time of maximum displacement control) shown in FIG. 2A, that is, when the second valve section 21B is in a fully-closed state, the first valve section 21C is in a fully-open state, the communicating holes 23 in the third valve section 21A are also in an open state, and the control fluid Pc (control fluid Pc of vaporized refrigerant liquid at the time of liquid refrigerant discharge) flows through the auxiliary communicating passages 21E, the intermediate communicating passage 26, and the communicating holes 23 into the third valve chest 4, and flows out from the third valve chest 4 into the third communicating passages 9.

In this state, the maximum opening area S2max between the communicating holes 23 and the third valve seat surface 12 is produced. The position of the communicating holes 23 is set such that the maximum opening area S2max is equal to or smaller than the area S1 of the auxiliary communicating passages 21E (when there are two or more auxiliary communicating passages, the total area). In this case, the opening area S2 is set so as to rapidly decrease in the initial stage of travel of the valve element 21, and thereafter, to be nearly constant.

A thick curved line of an arrow indicates the Pc-Ps flow path.

In a control area shown in FIG. 2B, the opening area S2 between the third valve seat surface 12 and the communicating holes 23 is set to a nearly constant value smaller than that of the area S1 of the auxiliary communicating passages 21E, and is in a range of 10% to 30% of Sl, for example.

At an OFF time when the second valve section 21B is in a fully-open state shown in FIG. 2C, S2 is not zero, leaving a space, whereas the Pc-Ps flow path becomes zero because the first valve section 21C is sealed with the first valve seat surface 31A.

Next, with reference to FIG. 3, the minimum area of the Pc-Ps flow path will be described.

In FIG. 3, the horizontal axis represents the stroke of the valve element 21, and the vertical axis the opening area.

The left end in FIG. 3 indicates the time of liquid refrigerant discharge, that is, a state where the second valve section 21B is fully closed (the first valve section 21C is fully open). Likewise, the right end in FIG. 3 indicates a state where the second valve section 21B is fully open (the first valve section 21C is fully closed). A range from the left end to a vertical line formed by a broken line in a nearly midpoint position on the horizontal axis represents the control area.

A horizontal line formed by a broken line in a nearly midpoint position on the vertical axis represents the area S1 of the auxiliary communicating passages 21E.

In the present invention, since the opening area S2 between the communicating holes 23 in the third valve section 21A and the third valve seat surface 12 in the control area is set smaller than the (fixed) area S1 of the auxiliary communicating passages 21E, the minimum area of the Pc-Ps flow path is defined by the opening area S2 between the communicating holes 23 in the third valve section 21A and the third valve seat surface 12.

Thus, the displacement control valve, in which the auxiliary communicating passages 21E are provided in the first valve section 21C in the first valve chest 7 in which fluid at the control pressure acts, and the pressure-sensitive device 22 and the third valve section 21A for discharging liquid refrigerant are disposed in the third valve chest 4 in which fluid at the suction pressure acts, can reduce the minimum area of the Pc-Ps flow path in the control area by the simple configuration of providing the communicating holes 23 in the third valve section 21A of the valve element 21.

In FIG. 3, the opening area S2 between the communicating holes 23 in the third valve section 21A and the third valve seat surface 12 in the control area is shown by a solid line. At the time of liquid refrigerant discharge at the left end, that is, in a state where the second valve section 21B is fully closed (the first valve section 21C is fully open), the maximum opening area S2max is produced, and the maximum opening area S2max is set equal to or nearly equal to the area S1 of the auxiliary communicating passages 21E. As the valve element 21 starts to travel, first, the opening area S2 is rapidly decreased from the area S1 of the auxiliary communicating passages 21E, and becomes a nearly constant value in a range of 10% to 30% of S1.

The rate of change in the opening area S2 with the travel of the valve element 21 between the communicating holes 23 in the third valve section 21A and the third valve seat surface 12 in the control area can be changed by the shape of the communicating holes 23.

In the example in FIGS. 1 to 2C, the front shape of the communicating holes 23 is substantially circular, the cross-sectional shape thereof is a stepped shape in which the side facing the third valve seat surface 12 is a large-diameter portion and the side facing the intermediate communicating passage 26 is a small-diameter portion. In the initial stage of travel of the valve element 21, almost all area of the large-diameter portion overlaps the third valve seat surface 12, rapidly decreasing the gap between them, and thereafter, a radial gap between the valve element 21 and the third valve seat surface 12 is left. Thus, the opening area S2 changes as shown by the solid line in FIG. 3.

The displacement control valve according to the first embodiment of the present invention is as described above, and achieves the following outstanding effects.

(1) The opening area S2 between the communicating holes 23 in the third valve section 21A and the third valve seat surface 12 in the control area to control the flow rate or pressure in the working control chamber is set smaller than the area S1 of the auxiliary communicating passages 21E, so that the displacement control valve, which is provided with the auxiliary communicating passages to be improved in the function of discharging liquid refrigerant in the control chamber at the time of startup of the variable displacement compressor, can reduce the minimum area of the Pc-Ps flow path in the control area, and can achieve a reduction in startup time and an improvement in operating efficiency during control of the variable displacement compressor simultaneously.

(2) The displacement control valve, in which the auxiliary communicating passages 21E are provided in the first valve section 21C in the first valve chest 7 in which fluid at the control pressure acts, and the pressure-sensitive device 22 and the third valve section 21A for discharging liquid refrigerant are disposed in the third valve chest 4 in which fluid at the suction pressure acts, can reduce the minimum area of the Pc-Ps flow path in the control area by the simple configuration of providing the communicating holes 23 in the third valve section 21A of the valve element 21.

(3) The maximum opening area S2max between the communicating holes 23 in the third valve section 21A and the third valve seat surface 12 when the second valve section 21B is in a closed state is set equal to or smaller than the area S1 of the auxiliary communicating passages 21E, so that the minimum area of the Pc-Ps flow path at the time of liquid refrigerant discharge can be made as large as that in the above-described conventional art.

Second Embodiment

Figure 4A:
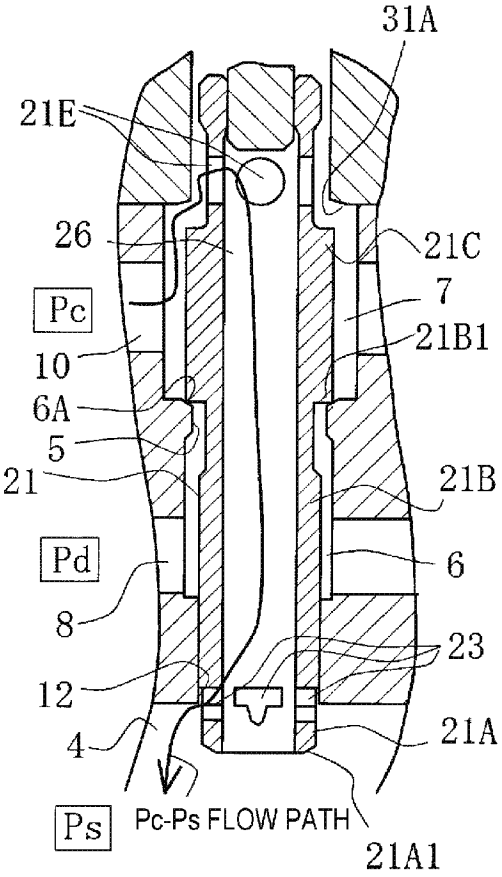
FIGS. 4A to 4C are enlarged views of a Pc-Ps flow path in a second embodiment, and are explanatory diagrams for explaining an opening area S2 between a third valve section and a third valve seat surface in different states.
Figure 4B:
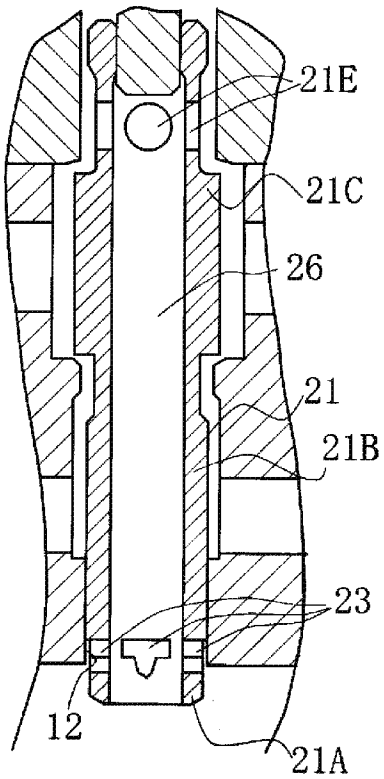
Figure 4C:
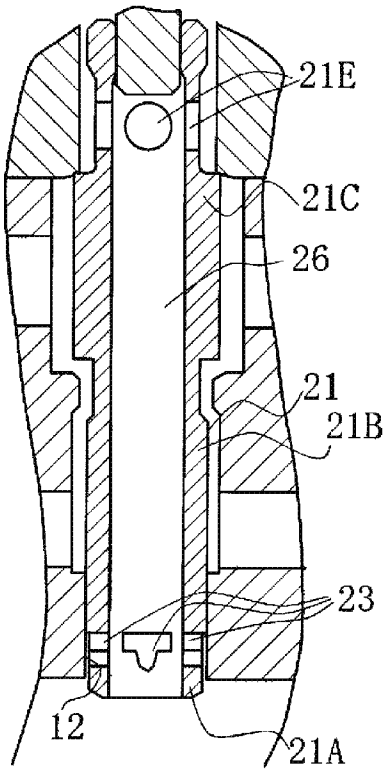
Figure 5:
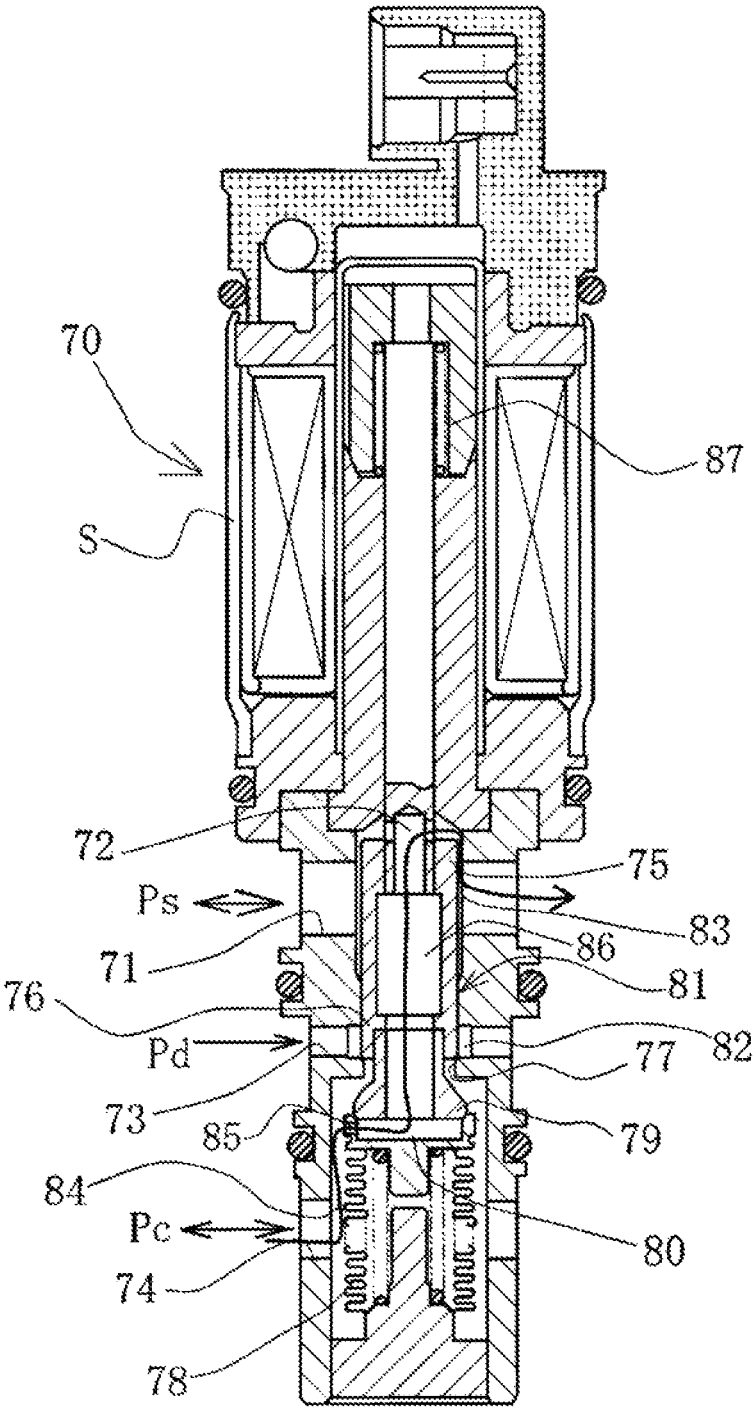
FIG. 5 RELATED ART
FIG. 5 is a front cross-sectional view showing the displacement control valve in the conventional art.
Figure 6:
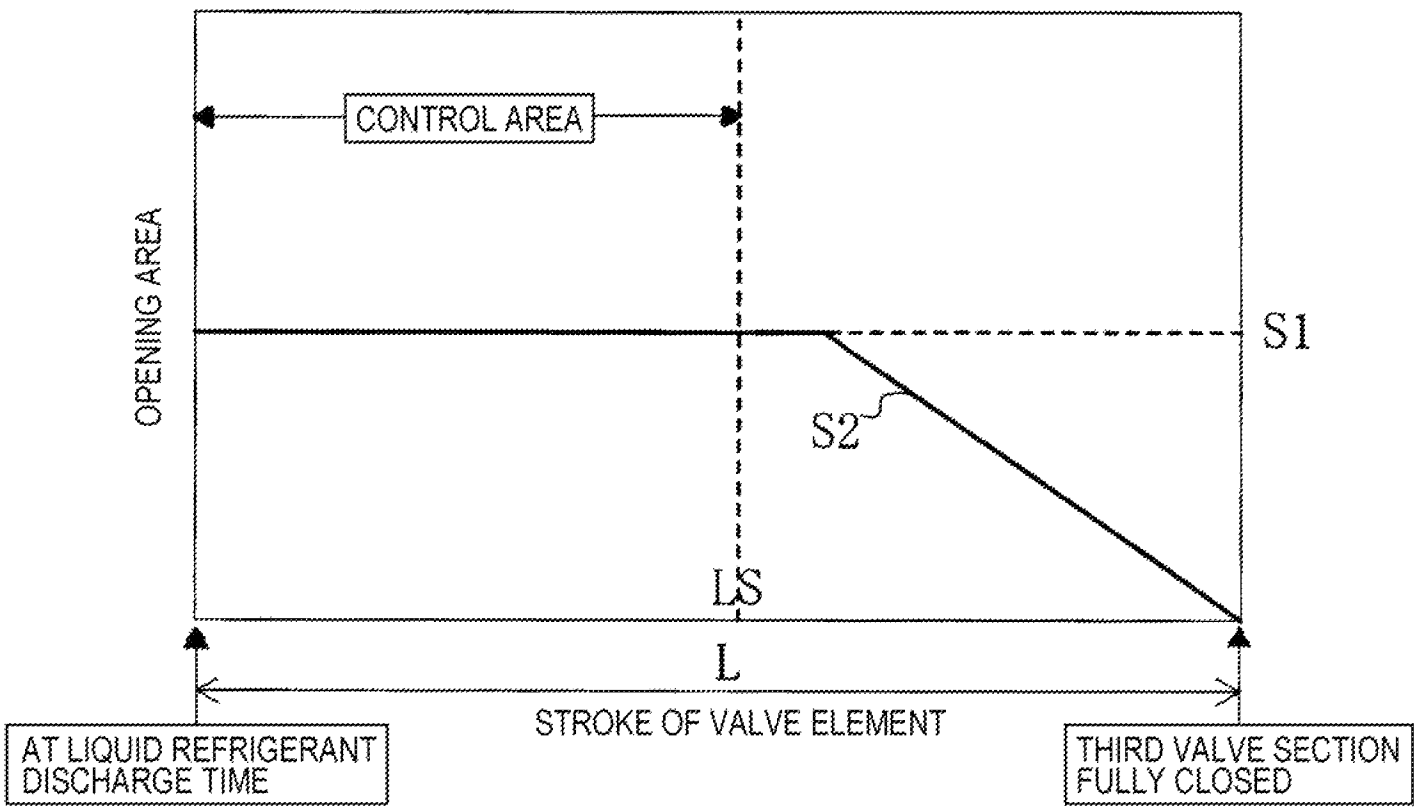
FIG. 6 RELATED ART
FIG. 6 is an explanatory diagram for explaining the relationship between the opening area S2 between the third valve section and a third valve seat surface and the area S1 of the auxiliary communicating passage of the displacement control valve according to the conventional art.

With reference to FIG. 4, a displacement control valve according to a second embodiment of the present invention will be described.

The displacement control valve according to the second embodiment is different from the displacement control valve in the first embodiment in the shape of communicating holes, but is identical to that of the first embodiment in the other basic configuration. The same members are provided with the same reference numerals and letters, and will not be described redundantly.

In FIG. 4, the front shape of communicating holes 23 is a T-like shape, and the cross-sectional shape thereof is uniform. In the initial stage of travel of a valve element 21 after the time of liquid refrigerant discharge (the state in FIG. 4A), a large opening at a horizontal portion of the T-like shape overlaps a third valve seat surface 12, rapidly decreasing a gap between them, and thereafter, a radial gap between the valve element 21 and the third valve seat surface 12 is left. Thus, the opening area S2 changes as shown by the solid line in FIG. 3.

Although the above second embodiment has described a case where the front shape of the communicating holes 23 is a T-like shape, the front shape of the communicating holes 23 is not limited to this, and may be an inverted triangle, a semicircle, or an ellipse, for example. It is essential only that the front shape of the communicating holes 23 be a shape having a portion with a large area that is closed in the initial stage of travel of the valve element 21 after the time of liquid refrigerant discharge, and a portion with a small area that is closed gradually thereafter.

Although the mode of carrying out the present invention has been described above with the embodiments, a specific configuration is not limited to these embodiments. Any changes and additions made without departing from the scope of the present invention are included in the present invention.

The invention claimed is:

1. A displacement control valve that controls a flow rate or pressure in a working control chamber according to a degree of opening of a valve unit, the displacement control valve comprising:

a valve body having:

a first valve chest that communicates with first communicating passages for passing fluid at control pressure and has a first valve seat surface and a second valve seat surface;

a second valve chest that has a valve hole communicating with the first valve chest and communicates with second communicating passages for passing fluid at discharge pressure;

a third valve chest that communicates with third communicating passages for passing fluid at suction pressure; and a third valve seat surface provided between the second valve chest and the third valve chest;

a valve element disposed in the valve body and having:

an intermediate communicating passage that communicably connects the first valve chest and the third communicating passages;

a second valve section that separates from and comes into contact with the second valve seat surface to open and close the valve hole communicating with the first valve chest and the second valve chest;

a third valve section that opens and closes opposite to and in conjunction with the second valve section and has a communicating hole that slides relatively to the third valve seat surface to open and close communication between the intermediate communicating passage and the third communicating passages; and a first valve section that is disposed in the first valve chest and opens and closes opposite to and in conjunction with the second valve section;

a pressure-sensitive element that is disposed in the third valve chest and extends and contracts in response to suction pressure, the pressure-sensitive element having, at an extending and contracting free end thereof, a valve seat that separates from and comes into contact with the third valve section to open and close communication between the third valve chest and the intermediate communicating passage;

an auxiliary communicating passage provided in the first valve section in the first valve chest and configured to enable communication between an interior of the first valve chest and the intermediate communicating passage; and a solenoid unit mounted to the valve body and actuating the valve element in a travel direction to open and close the valve sections of the valve element according to a current, wherein an opening area between the communicating hole in the third valve section and the third valve seat surface in a control area to control the flow rate or pressure in the working control chamber is smaller than an area of the auxiliary communicating passage.

2. The displacement control valve according to claim 1, wherein a maximum opening area between the communicating hole in the third valve section and the third valve seat surface when the second valve section is in a closed state is equal to or smaller than the area of the auxiliary communicating passage.

* * * * *